US011517077B2

(12) United States Patent
Ben-Arie

(10) Patent No.: US 11,517,077 B2
(45) **Date of Patent: *Dec. 6, 2022**

(54) BELT RATCHETING DEVICE WITH HIDDEN BLADE II

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/665,298

(22) Filed: Feb. 4, 2022

(65) Prior Publication Data

US 2022/0202140 A1 Jun. 30, 2022

Related U.S. Application Data

(63) Continuation-in-part of application No. 17/134,247, filed on Dec. 25, 2020, now Pat. No. 11,241,067.

(51) Int. Cl.
*A44B 11/06* (2006.01)
*A44B 11/12* (2006.01)

(52) U.S. Cl.
CPC ..... *A44B 11/065* (2013.01)

(58) Field of Classification Search
CPC ..... A44B 11/065; A44B 11/125; A44B 11/12
See application file for complete search history.

(56) References Cited

U.S. PATENT DOCUMENTS 1,506,349 A * 8/1924 Kerngood ..... A44B 11/125 24/191
2,888,729 A * 6/1959 Lethern ..... B64D 25/06 24/DIG. 48
4,071,964 A 2/1978 Vogiatzis
4,125,918 A 11/1978 Baumann
4,130,949 A 12/1978 Seidel
4,261,081 A 4/1981 Lott
4,420,858 A * 12/1983 Noda ..... A44B 11/12 24/191
4,458,373 A 7/1984 Maslow
4,507,878 A 4/1985 Semouha
4,616,432 A 10/1986 Bunch
4,648,159 A 3/1987 Dougherty
4,991,273 A 2/1991 Huttle
5,001,847 A 3/1991 Waters
5,097,573 A 3/1992 Gimeno
5,109,581 A 5/1992 Gould
(Continued)

FOREIGN PATENT DOCUMENTS

DE 3344489 A1 12/1983

*Primary Examiner* — David M Upchurch

(57) ABSTRACT

The Belt Ratcheting Device with Hidden Blade II (HB-II) facilitates unidirectional belt fastening and fast release. The HB-II includes a turning gate rotatably installed diagonally in a channel. The turning gate has a hidden sharp blade front which operates below on the lower belt surface avoiding visible scratches. The turning gate is connected to a lever by a spring. The HB-II has two states: "active" and "inactive". In the active state the device works as a belt ratchet i.e. allowing the belt to be pulled forwards but restricting any belt motion backwards. In the inactive state the ratcheting is disabled and the belt is released. The HB-II is controlled by the lever's position. After fastening, the belt remains fastened until the HB-II is switched manually into inactive state by moving the lever. The blade's smooth side and channel's smooth surfaces minimize belt wear.

14 Claims, 4 Drawing Sheets

(56) References Cited

U.S. PATENT DOCUMENTS

| | | | | |
|---|---|---|---|---|
| 5,119,539 | A | 6/1992 | Curry | |
| 5,177,882 | A | 1/1993 | Berger | |
| 5,203,053 | A | 4/1993 | Rudd | |
| 5,230,171 | A | 7/1993 | Cardaropoli | |
| 5,293,669 | A | 3/1994 | Sampson | |
| 5,293,675 | A | 3/1994 | Shai | |
| 5,295,315 | A | 3/1994 | Osawa | |
| 5,335,401 | A | 8/1994 | Hanson | |
| 5,467,511 | A | 11/1995 | Kubo | |
| 5,477,593 | A | 12/1995 | Leick | |
| 5,572,774 | A | 11/1996 | Duran | |
| 5,572,777 | A | 11/1996 | Shelton | |
| 5,588,186 | A | 12/1996 | Ko | |
| 5,647,824 | A | 7/1997 | Levenson | |
| 5,661,877 | A * | 9/1997 | Bloomer | A44B 11/12 24/309 |
| 6,076,241 | A | 6/2000 | Borel | |
| 6,094,787 | A | 8/2000 | Chang | |
| 6,192,241 | B1 | 2/2001 | Yu | |
| 6,192,559 | B1 | 2/2001 | Munsell | |
| 6,282,817 | B1 | 9/2001 | Curet | |
| 6,334,240 | B1 | 1/2002 | Li | |
| 6,339,867 | B1 | 1/2002 | Azam | |
| 6,438,871 | B1 | 8/2002 | Culverwell | |
| 6,588,079 | B1 | 7/2003 | Manzano | |
| 6,622,358 | B1 | 9/2003 | Christy | |
| 6,729,000 | B1 | 5/2004 | Liu | |
| 6,735,829 | B2 | 5/2004 | Hsu | |
| 6,938,308 | B2 | 9/2005 | Funk | |
| 7,082,701 | B2 | 8/2006 | Dalgaard | |
| 7,100,901 | B2 | 9/2006 | Gleinser | |
| 7,152,285 | B2 | 12/2006 | Liao | |
| 7,313,849 | B2 | 1/2008 | Liu | |
| 7,320,161 | B2 | 1/2008 | Taylor | |
| 7,360,282 | B2 | 4/2008 | Borsoi | |
| 7,591,050 | B2 | 9/2009 | Hammerslag | |
| 7,681,289 | B2 | 3/2010 | Liu | |
| 8,046,937 | B2 | 11/2011 | Beers | |
| 8,141,273 | B2 | 3/2012 | Stramare | |
| 8,230,560 | B2 | 7/2012 | Luzlbauer | |
| 8,231,074 | B2 | 7/2012 | Hu | |
| 8,332,994 | B2 | 12/2012 | Lin | |
| 8,371,004 | B2 | 2/2013 | Huber | |
| 8,381,362 | B2 | 2/2013 | Hammerslag | |
| 9,185,948 | B2 | 11/2015 | Ben-Arie | |
| 2002/0002781 | A1 | 1/2002 | Bouirer | |
| 2003/0226284 | A1 | 12/2003 | Grande | |
| 2005/0005477 | A1 | 1/2005 | Borsoi | |
| 2006/0213085 | A1 | 9/2006 | Azam | |
| 2007/0169380 | A1 | 7/2007 | Borsoi | |
| 2008/0250618 | A1 | 10/2008 | Stramare | |
| 2009/0172929 | A1 | 7/2009 | Hwang | |
| 2010/0115744 | A1 | 5/2010 | Fong | |
| 2011/0094072 | A1 | 4/2011 | Lin | |
| 2013/0008056 | A1* | 1/2013 | Vincent | A43C 11/146 36/114 |
| 2013/0239375 | A1* | 9/2013 | Horimoto | A44B 11/16 24/69 ST |
| 2014/0224190 | A1* | 8/2014 | Waters | A01K 27/005 24/492 |
| 2015/0113770 | A1 | 4/2015 | Laatz | |
| 2016/0166013 | A1* | 6/2016 | Szewczyk | A44B 11/125 24/69 SB |
| 2016/0338451 | A1* | 11/2016 | Scoffier | A44B 11/125 |
| 2017/0065034 | A1* | 3/2017 | Tsai | A44B 11/12 |
| 2017/0258160 | A1* | 9/2017 | Rowland | A44B 11/24 |

* cited by examiner

BELT RATCHETING DEVICE WITH HIDDEN BLADE II

CROSS-REFERENCE TO RELATED APPLICATIONS

This application is Continuation In Part of application Ser. No. 17/134,247 Filed on Dec. 25, 2020.

FEDERALLY SPONSORED RESEARCH

Not Applicable

SEQUENCE LISTING OR PROGRAM

Not Applicable

FIELD OF THE INVENTION

The invention is related to ratcheting devices for fastening belts, bands, straps, ribbons, cloth belts, suspenders, sandals, brassieres, watch bands, garment belts strips, laces chords, ropes, strings and alike.

BACKGROUND OF THE INVENTION—PRIOR ART

Several inventions were concerned with ratchet mechanisms configured for fastening waist belts. In U.S. Pat. No. 5,588,186A Soon-Myung Ko filed in 1995 May 26 a patent which teaches a belt with improved ratchet type buckling means. The ratcheting mechanism was constructed by a toothed belt and a releasable pawl in the buckle. In Application US20150113770A1 filed on 2014 Mar. 18 Robin LaatzKore taught a ratchet belt system which comprised a belt with a notch strip which extends along a portion of the length of the belt. The notch strip is formed of a plurality of adjacent notches, each being configured to engage a ratcheting pawl in the buckle. In principle, the notch strip is very similar to the toothed belt. Another invention which teaches a similar structured ratchet mechanism is presented by Jong Lee in application filed on 2004 May 7. The structure of toothed belt and similarly a notch strip belt is quite expensive to manufacture and is susceptible to accelerated wear since the imprinted belt is made of soft material. Furthermore, the ratchet pawl applies a strong shear force which equals to the total fastening force just on one tooth of the toothed belt. This shear force plays a major role in the belt's accelerated wear. In addition, the toothed structure is configured to provide fastening stations only at discrete spaces along the belt. In contrast, our invention does not suffer from these drawbacks.

Another prevalent approach for belt ratcheting is based on a ratchet wheel which rotates while mechanically linked to a cylinder with rough surface which compresses and fastens the belt. Such are the invention of Smetz-Rud Ketten et al. in patent application DE3344489A1 filed on 1983 Dec. 6. Also in U.S. Pat. No. 5,647,824A filed on 1995 Oct. 25, Levenson teaches a Weight lifter's belt incorporating strap fastened by a ratchet wheel. In U.S. Pat. No. 7,100,901B2 filed on 2001 Jun. 28 Gerhard Gleinser taught a Tension ratchet with a belt magazine also utilizing a ratchet wheel mechanism. Ratchet wheel mechanism is utilized in many other belt fastening inventions. In another approach, described in application Ser. No. 16/297,655 filed on Mar. 9, 2019 Jezekiel Ben-Arie taught a belt ratcheting device which employs an adaptive blocking mechanism which restricts belt motion backward by a turning gate which applies an increasing pressure force on the belt, which is proportional to the backward pulling force, when the turning gate is turned backward by the belt motion backward. The adaptive blocking mechanism facilitates belt motion forward by the turning gate which diminishes the pressure force on the belt when the turning gate is turned forward by the belt motion forward. However, as detailed in the following sections, the adaptive blocking mechanism of Ben-Arie's ratcheting device has different structure compared to the belt ratcheting device described in the current application.

Many devices were invented for shoe lace tightening. The most commercially successful is U.S. Pat. No. 6,339,867 by Azam which is widely used in fastening laces of skiing and skates boots. The tightening principle is a spring loaded gear wheel which can move in wedge shaped passage which widens forward and narrows backward. The laces pass through that passage and can be fastened by pulling the laces forward which in turn pulls forward the gear wheel towards the wider part of the passage where the laces are free to move. When the pulling stops the laces pull the gear wheel backward, which narrows the passage and blocks the laces' backward motion. The laces can be released by pulling the gearwheel forward with a knob. There are few noticeable disadvantages to this popular invention. The device must be installed on heavy-solid footwear which eliminates its use with regular shoes and the user must constantly pull the knob to keep the releasing. In addition, the teeth of gearwheel and opposite teeth cause severe lace wear. Similar approach is taken in U.S. Pat. No. 7,360,282 by Borsoi and in U.S. Pat. No. 8,141,273 by Stramare. The lace buckle device described in U.S. Pat. No. 6,334,240 by Li is used widely in coat laces. It has a lace passage controlled by a spring loaded piston that blocks lace motion when the spring is released. Except for the similar name there is no similarity to our invention. This buckle controls only one lace and does not have a ratchet operation at all. When the user wants to release or fasten the lace the user has to press the spring loaded piston, release the lace and pull at the same time. When the spring is released, the buckle returns to b the lace. Similar devices are sold as "shoe buckles" for fastening shoe laces. The main disadvantage of such shoe buckles is that they do not have a ratcheting operation, which enables one to fasten the laces just by pulling. The shoe buckles require one to fasten the laces with one hand while keeping the buckle in open position with the other hand and then switching the buckle into locked position. This results in cumbersome and inefficient fastening.

In U.S. Pat. No. 6,729,000 Liu uses for lace tightening a teethed rotating bar. In U.S. Pat. No. 6,076,241 by Borel and in several others such as in U.S. Pat. No. 6,622,358 to Christy and in U.S. Pat. No. 6,192,241 by Yu et al. use fastening devices which are based on pipes or channels which have diagonal teeth to block reverse motion of the lace. The pipes are installed on the shoes in different locations.

In U.S. Pat. No. 8,371,004 Huber teaches a lace mechanism. Huber's mechanism employs a pair of spring loaded pivoted arms which have sets of sharp teeth that when pressed against the laces block their motion in both directions. Thus, Huber's mechanism is not a lace ratchet mechanism because it does not allow further lace tightening once it is. In its state, the laces are released in both directions simply by pressing the arms of Huber's mechanism. Huber's mechanism is impractical because the sharp teeth tend to cause a lot of lace wear when the laces are fastened before. Huber's mechanism structure is complex and expensive to manufacture. In addition, similar to the lace buckle, the user needs to fasten both laces with one hand while pressing the arms with the second hand to keep the mechanism in position. In U.S. Pat. No. 8,332,994 Jih-Liang Lin teaches a shoe lace fastener which fasten the lace using jagged arm on top and jagged base on bottom. The device structure includes many complex parts and is expensive to manufacture. Such a structure also is impractical because it will wear the lace very quickly. In U.S. Pat. No. 8,381,362 to Hammerslag et al. teaches Real based closure system. U.S. Pat. No. 8,332,994 to Lin teaches Shoelace with shoelace fastener. U.S. Pat. No. 8,141,273 to Stramare et al. describes Shoes with directional conditioning device for laces. U.S. Pat. No. 8,231,074 to Hu et al. describes Lace winding device for shoes. U.S. Pat. No. 8,230,560 to Luzlbauer teaches Fastening system for shoes.

U.S. Pat. No. 9,185,948 to Ben-Arie describes a Buckle Lace Fastening Device (BLFD) which also enables lace ratcheting. However, the BLFD is using resilient gates which do not rotate but bend. In addition, the mechanism of the BLFD, which is based on rotating the gripping wall is entirely different from the mechanism of the current invention.

U.S. Pat. No. 8,046,937 to Beers et al. describes an Automatic lacing system. U.S. Pat. No. 7,681,289 to Liu describes a Fastener for fasting together two lace systems. U.S. Pat. No. 7,591,050 to Hammerslag describes a Footwear lacing system. U.S. Pat. No. 7,320,161 to Taylor describes a Lace tying device. U.S. Pat. No. 7,313,849 to Liu describes a Fastener for lace. U.S. Pat. No. 7,152,285 to Liao describes a Shoe lace fastening device. U.S. Pat. No. 7,082,701 to Dalgaard describes Footwear variable tension lacing systems. U.S. Pat. No. 6,938,308 Funk describes a lace securing and adjusting device. U.S. Pat. No. 6,735,829 Hsu describes a U shaped lace buckle. In U.S. Pat. No. 6,588,079 to Manzano describes a Shoelace fastening assembly. U.S. Pat. No. 6,438,871 to Culverwell describes Footwear fastening. U.S. Pat. No. 6,192,559 to Munsell Jr. describes a Shoelace fastening apparatus. U.S. Pat. No. 6,094,787 to Chang describes a Fastening device. U.S. Pat. No. 5,572,777 to Shelton describes a Shoelace tightening device. U.S. Pat. No. 5,572,774 to Duren teaches a Shoe fastening attached device. U.S. Pat. No. 5,467,511 to Kubo describes a Shoelace fastening device. U.S. Pat. No. 5,335,401 to Hanson teaches a Shoelace tightening and device. U.S. Pat. No. 5,295,315 to Osawa et al. describes a Shoe fastening device and plate shaped member thereof. U.S. Pat. No. 5,293,675 to Shai describes a Fastener for shoelace. U.S. Pat. No. 5,293,669 to Sampson teaches a Multiuse fastener system. U.S. Pat. No. 5,230,171 to Cardaropoli teaches a Shoe fastener. U.S. Pat. No. 5,203,053 to Rudd teaches a Shoe fastening device. U.S. Pat. No. 5,177,882 to Berger teaches a Shoe with central fastener. U.S. Pat. No. 5,119,539 to Curry teaches a Lace fastener. U.S. Pat. No. 5,109,581 to Gould teaches a Device and method for securing a shoe. U.S. Pat. No. 4,991,273 to Huttle teaches Shoe lace fastening. U.S. Pat. No. 4,648,159 to Dougherty teaches a Fastener for lace or rope or the like. U.S. Pat. No. 4,616,432 to Bunch et al. teaches a Shoe upper with lateral fastening arrangement. U.S. Pat. No. 4,507,878 to Semouha teaches a Fastener mechanism. U.S. Pat. No. 4,458,373 to Maslow teaches Laced shoe and method for tying shoelaces. U.S. Pat. No. 4,261,081 to Lott teaches a Shoelace tightener. U.S. Pat. No. 4,130,949 to Seidel teaches Fastening means for sports shoes. U.S. Pat. No. 4,125,918 to Baumann teaches a Fastener for lace shoes. U.S. Pat. No. 4,071,964 to Vogiatzis teaches a Footwear fastening system. U.S. Pat. No. 5,097,573 to Gimeno teaches Fastening Device for Lace Up Shoes. U.S. Pat. No. 5,001,847 to Waters teaches a Lace Fastener. U.S. Pat. No. 5,477,593 to Leick teaches a Lace Device. U.S. Pat. No. 6,282,817 to Curet teaches an Apparatus and Method for Lacing.

US PATENT APPLICATIONS

In US 2011/0094072 to Lin describes a Shoelace with Shoelace Fastener. In US 2010/0115744 to Fong describes a Lace Fastener. In US 2009/0172929 to Huang describes a Device for tying Shoe laces. In US 2008/025068 to Stramare describes a Shoe with Directional Conditioning Device for lace or the like. In US 2007/0169380 to Borsoi teaches a Device for B Flexible Strands. In US 2006/0213085 to Azam teaches an Article for Footwear with Linkage Tightening Device. In US 2005/0005477 to Borsoi teaches a Lace B Device. In US 2003/0226284 to Grande teaches a Lacing System For Skates. In US 2002/0002781 to Bourier teaches a Lace Tightening Device Having a Pocket for Storing a B Element.

On 02/17/2020 Ben-Arie filed application Ser. No. 16/792,324 entitled "Belt Ratcheting Device III" (BRD-III), which was configured to achieve similar objectives to the objectives listed in next Section below. However, the BRD-III employed a blade which engaged the upper surface of the belt and caused scratch marks on the upper surface of the belt. Thus the main goal of the "Belt Ratcheting Device with Hidden Blade II IV" (HB-II) described below is to avoid such scratch marks.

On 12/25/2020 Ben-Arie filed application Ser. No. 17/134,247 entitled "Hidden Blade Belt Ratcheting Device IV" which was configured to achieve similar objectives to the objectives listed in next Section below. The BRD-IV employed a blade which engaged the lower surface of the belt and did not cause scratch marks on the upper surface of the belt. However, BRD-IV employed a bulky ratchet mechanism which did not provide elegant appearance to the belt. Thus the main goal of the "Belt Ratcheting Device with Hidden Blade II" (HB-II) described below is to provide compact and elegant appearance.

BRIEF SUMMARY OF THE INVENTION

The objective of the invention of the: "Belt Ratcheting Device with Hidden Blade II" (HB-II) is to achieve the following goals:

1. A major goal of the invention is to configure a Belt Ratcheting Device with Hidden Blade II (HB-II) that facilitates a linear and continuous ratcheting of belts. It is required to configure ratcheting mechanism that enables to fasten a large variety of belts which engages only the lower surface of the belts in order to avoid visible scratch marks on the belts' upper surfaces. It is also desired that the configuration of the ratcheting mechanism will be based on a novel structure which yields a linear, continuous and smooth ratcheting. The HB-II is a continuous ratcheting method which is entirely different from traditional discrete ratcheting methods which employ a pawl and require a pattern belt imprinting such as: notch strips or toothed surfaces. Our novel ratcheting mechanism employs a turning gate with a hidden blade front which is installed diagonally in a channel and in its active state allows only unidirectional belt translation. This HB-II does not need belt imprinting and enables fastening of a large variety of smooth surface belts made not just of leather but also of cloth, plastics, or other elastic materials.

2. A second target of the invention is to develop a HB-II that allows to achieve a continuous and accurate level of fastening i.e., the user has just to pull the belt exactly to the desired level of fastening and the belt does not slip backward and remains fastened exactly at the desired fastening level after the pulling ceases. In contrast to HB-II, other ratchet belts currently in the market provide only discrete levels of fastening. This entails that the HB-II is to be configured to have a slip less, continuous ratcheting mechanism, which strongly restricts belt motion backward but facilitates forward motion of the belt. In addition, the HB-II has a turning gate which applies on the belt a blocking force which is proportional to the backward force applied on the belt. The forward direction in the belt ratcheting device HB-II is defined as the direction of the belt translation from the belt entrance towards the belt's exit.
3. A third objective of the invention is to design a HB-II with a linear ratcheting mechanism which is mechanically more reliable because it depends on a simple structure which employs a minimal number of moving parts and therefore minimizes malfunction probability.
4. A fourth goal of the invention is to design a HB-II with a linear ratcheting mechanism which causes minimal belt wear on the lower surfaces of the belts and does not engage the upper surface of the belt. The hidden blade of the HB-II has a smooth side and the gipping wall also has smooth surface which facilitate belt sliding with minimal wear.
5. A fifth target of the invention is to design a HB-II with a releasing mechanism which is quick and easy to operate manually. The HB-II is configured to be switched from active fastening state to inactive releasing state simply by pulling a lever which pulls a spring that turns forward the turning gate which increases the gap between the blade front and the gripping wall. The wider gap diminishes the pressure force applied on the belt by the blade and releases the belt.
6. A sixth objective of the invention is to design a HB-II with a ratcheting mechanism structure, which is suited for low-cost manufacturing and assembly because it has a simple structure which employs minimal number of moving parts. Furthermore, in order to facilitate low-cost manufacturing, the HB-II is designed to be manufactured from plastic materials in its entirety except for a metallic blade. In order to achieve low-cost production and for economic manufacturing and assembly the HB-II mechanism also employs plastic axles and bearings.
7. A seventh objective of the invention is to configure a HB-II with low profile which is suitable also for fastening belts of footwear, garments, brassieres, watches, or any other objects which employ belts.

This specification describes an embodiment of the invention that is a belt ratcheting configuration which has a belt ratcheting mechanism which is designed for ratcheting a large variety of belts which could have different thicknesses and widths and could have been made of different materials. This embodiment also facilitates easy fastening of belts, laces, ropes, strings and alike. The basic Belt Ratcheting Device with Hidden Blade II (HB-II) can be configured to have a compact size and thus it can be used to fasten belts, bands, straps, ribbons, waist belts, suspenders, sandals, brassieres, watch bands, garment belts, and any sort of belts or bands connected to or used for wrapping of objects which need fastening. The HB-II can be used to fasten a belt simply by inserting the belt into the HB-II and pulling it. The HB-II has a linear ratcheting mechanism with two states: "active" and "inactive". In the inactive state the ratcheting mechanism is disabled and the belt is free to move forward and backward. In the active state the device works as a linear belt ratchet i.e. allowing the belt to be pulled forward but severely restricts or even completely blocks any belt motion backward. After the user has fastened the belt it remains fastened until the mechanism is switched into the inactive state. The HB-II ratcheting mechanism can be regarded also as an adaptive blocking mechanism which applies on the belt a blocking pressure which is proportional to the backward pulling force applied on the belt. This adaptive blocking mechanism is adaptive and restricts backward belt motion very efficiently because it generates a pressure force which results in a friction-based belt blocking force which is proportional to the belt's backward pulling force. So, the hardest the belt is pulled backward the strongest is the blocking force generated by the ratcheting mechanism which prevents it from moving backward.

The HB-II has a channel for fastening one belt. In the embodiment described here, the channel comprises a gripping wall adapted with a gripping surface. The channel includes two major openings: an entrance for the belt and an exit for the belt. The forward direction in the channel is defined as the direction from the entrance to the exit. The backward direction is opposite to the forward direction. A turning gate is rotatably installed in the channel on an axle, which is supported by two bearings installed in the channels' side walls. The axle is centered at the turning gate's fulcrum located at the turning gate's axis of rotation. The turning gate comprises of a blade holder at the turning gate's front end and an elastic part which is in the current embodiment an extension spring which is connected to an off-axial post at the turning gate. Pulling or pushing at the off-axial post creates moment of rotation which tends to turn the turning gate around its axis of rotation. The axis of rotation is situated between the front end and the rear end of the turning gate. The blade holder holds a blade which includes a tapered and sharp blade front. The blade is inserted into the blade holder such that the sharp blade front protrudes in front of the blade holder. The blade is tapered gradually narrowing towards the blade front and ending with a sharp blade front, which protrudes in front of the blade holder. The sharp blade front is adapted with a smooth side. The sharp blade front is configured to concentrate the pressure force on the belt when the turning gate is turned backward while the sharp blade front engages the belt. The smooth side is configured to engage the belt when the turning gate is turned forward. The smooth side is configured to facilitate sliding of the belt while the turning gate is turned forward and the belt is translated in the forward direction.

The surface of the gripping wall i.e., the gripping surface is adapted with a smooth surface. The smooth surface is configured to facilitate sliding of the belt when the belt is fastened forward during the active state and also when the belt is translated forward or backward during the inactive state.

As an option, the HB-II may comprise one or more bulges, which are disposed on the gripping surface of the gripping wall. The bulges are configured to cause an additional bending of the belt due to the pressure force applied on them by the blade's front. The additional bending is configured to increase a mutual friction force between the belt and the gripping surface while the HB-II is in the active state and the belt is pulled in the backward direction.

As another option, the gripping wall could comprise a recess (a depression) opposite the blade front end. The recess is configured to cause an additional bending of the belt due to the pressure force applied on it by the blade's front end. The additional bending is configured to increase the mutual friction force between the belt and the gripping surface while the HB-II is in the active state and the belt is pulled in the backward direction.

The turning gate is installed in the channel in a forward leaning diagonal orientation. As illustrated in FIG. 6, A straight line emanating from the blade front and passing through the axis of rotation (i.e. the fulcrum) is at an obtuse angle (i.e. an angle greater than 90 degrees but less than 180 degrees) with respect to the forward direction. It means that the obtuse angle which is centered at the blade front and is measured between the two lines emanating from the angle's center (the blade front). One line starts at the angle's center and passes through the axis of rotation and the second line starts at the angle's center and is parallel to the forward direction of the channel. The blade front is disposed within the channel opposite the gripping wall and there exist a gap between the blade front and the gripping surface of the gripping wall. The belt that is transported in the channel is configured to pass through the gap between the blade front and the gripping surface. In the HB-II structure the gripping surface is situated above the blade. This results in the blade engaging the lower surface of the belt which translates via the gap between the gripping surface and the blade. So the blade is hidden below the belt.

Due to the diagonal position of the turning gate in the channel, when the turning gate is turned increasingly backward, the turning gate is configured to reduce the gap and consequently to increase the pressure force exerted by the blade front on the belt. The gate is considered as turning backward when the front end travels backward while turning. The gate is considered as turning forward when the front end travels forward while turning. Due to the diagonal construction of the turning gate in the channel, when the turning gate is turned increasingly forward, the turning gate is configured to increase the gap and consequently to reduce the pressure force exerted by the blade front on the belt.

When the HB-II is at the active state, the blade front is configured to exert a pressure force on the belt and to engage frictionally with the belt. Since the blade front is configured to frictionally engage the belt it is also configured to turn forward the turning gate when the belt is translated in forward direction and drags forward the front end due to their mutual friction. Similarly, at the active state the blade front is configured to frictionally engage the belt and to turn backward the turning gate when the belt is translated in backward direction and drags backward also the front end due to their mutual friction.

The turning gate is configured to facilitate forward translation of the belt by turning increasingly forward while increasing the gap and consequently diminishing the pressure force of the blade front on the belt. On the other hand, the turning gate is configured to restrict backward translation of the belt by turning increasingly backward while reducing the gap and consequently increasing the pressure force of the blade front on the belt. Hence, in the active state of the HB-II the turning gate is configured to allow only unidirectional translation of the belt in the forward direction. On the other hand, while the ratcheting device is in the inactive state, the blade front is configured not to exert pressure force on the belt and translation of the belt is facilitated both in the forward direction and in the backward direction.

The elastic part which is at the current embodiment an extension spring is connected to an off-axial post of the turning gate. While in the active state, the resilient part i.e. the spring is configured to be at a stretched state (biased state) and is configured to apply backward turning force on the turning gate. The backward turning force is configured to turn the turning gate backward, which is configured to reduce the gap and consequently to apply a pressure force on the belt. Thus, while at the active state the turning gate is configured to apply a pressure force on the belt.

While in the active state, the extension spring is held in a stretched state by a lever which is connected to the other end of the extension spring. The lever is held at an active lever position determined by the position of the lever's upper end in an L-shaped slit at the upper wall of the belt buckle box. When upper end of the lever is manually moved to the inactive lever position in the L-shaped slit, the extension spring is configured to be released from its stretched state and the turning gate is configured to turn forward and to diminish the pressure force on the belt. Thus, moving the lever from the active lever position into the inactive lever position switches the ratcheting device from the active state into the inactive state.

In order to facilitate HB-II switching from the active state into the inactive state, the turning gate is attached to a leaf spring at a leaf spring first end wherein the leaf spring second end is unattached and is situated. a leaf spring is attached to the turning gate. An unattached end of the leaf spring is configured to fit into a cavity which is constructed into a channel's wall. The leaf spring is configured to be at an unbent state when the ratcheting device is in the inactive state. Moving the lever into the active lever position is configured to switch the ratcheting device into the active state by turning backward the turning gate. The leaf spring is configured to bend when the turning gate turns backward into the active state.

When the lever is moved into the inactive lever position it creates a forward spring force which is configured to switch the ratcheting device into the inactive state by turning forward the turning gate. The leaf spring is configured to supplement the forward spring force by providing an unbending force which helps to turn forward the turning gate.

When the ratcheting mechanism is in active state, the gap has been narrowed such that the blade front (i.e. front end) applies a pressure force which is squeezing the belt in the gap with its blade front i.e. the sharp blade front against the gripping surface. At this situation, the turning gate acts as a belt ratchet. It means that the turning gate allows forward fastening motion of the belt but blocks or severely restricts any belt translation in backward direction. In order to have a belt ratchet operation, the turning gate is installed in a forward leaning diagonal orientation in the channel such that its blade front is closer to the gripping wall than the gate's axis of rotation. Also, in a forward leaning diagonal state, the turning gate's blade front (front end) is closer to the channel's exit than the turning gate's axis of rotation. The definition here of forward leaning diagonal orientation of the turning gate is equivalent to the definition above in Section [0019] of the orientation of the turning gate which is based on a straight line emanating from the blade front and passing through the axis of rotation (i.e. fulcrum) which is at an obtuse angle (i.e. angle greater than 90 degrees but smaller than 180 degrees) with respect to the forward direction.

The ratchet operation of the gate stems from the forward leaning diagonal orientation of the turning gate, which allows forward belt motion when the belt is pulled forward.

Pulling forward the belt, which is squeezed in the gap, drags forward the turning gate's blade front due to the friction force which naturally exists between the belt and the blade front as a natural consequence of the pressure force applied by the blade front on the belt. Thus, when the front end is dragged forward also the turning gate turns forward. Due to the forward leaning diagonal orientation of the turning gate, when its blade front is turned forward it is moved forward and it also has a motion component that moves it laterally inwards i.e. away from the gripping wall, whereby increasing the width of the gap between the blade front and its gripping wall which in turn results in diminished pressure force of the blade front on the belt. Reduced pressure force on the belt results in reduced friction between the belt and the gripping surface of the gripping wall and also reduced friction between the belt and the blade's front. This facilitates even easier forward motion of the belt.

On the other hand, if the belt is pulled backward, it also drags the turning gate's blade front backward (i.e. turning the turning gate backward) since the blade front applies a squeezing force on the belt, which results in a mutual friction force with the belt. Hence, when the blade front moves backward also the turning gate turns backward as well. Due to the forward leaning diagonal orientation of the gate, the motion backward of the blade front has also a lateral outwards motion component which moves the blade front (at the front end) towards the gripping wall thus further narrowing the gap and further restricting backward belt motion. Hence, in an active state the gate acts as a belt ratchet i.e. allows belt forward motion but severely restricts belt's backward motion. When the ratcheting mechanism is switched into inactive state by turning the turning gate forward, the gap is widened more than the belt's width and the belt is entirely released because it can move freely forward or backward in the channel without engaging the blade. The user can easily switch the ratcheting mechanism from active to inactive state simply by manually turning up the lever from active lever position into inactive lever position which also turns forward the spring attached turning gate. When the gate turns forward and increases the gap's width it also inactivates the ratchet mechanism of the HB-II. On the other hand, when the lever is turned into the active lever position, it also turns the spring attached turning gate backward into the active state. The HB-II can be manufactured at low cost because it has a simple structure with only few parts, which could be made from plastic materials at its entirety except the metallic blade.

The HB-II's structure is different from other belt fastening devices in few important aspects. Primarily, the HB-II enables a belt ratcheting operation which causes only minimal wear of the belt since it employs in the channel a novel structure with a diagonally forward leaning turning gate with a single tapered blade front at its front end, i.e. single sharp blade front which is configured to have a smooth side (for certain applications, such as in controlling wide belts, the front end can be split into several blades if more efficient). When the belt is moved forward, the tapered blade end i.e. sharp blade front at the front end of the turning gate rotates forward this also turns the smooth side of the tapered end to be approximately parallel with the belt and the belt is sliding on the smooth side of the tapered end i.e. causing minimal wear of the belt. To further reduce belt's wear, the gripping wall opposite to the blade front (i.e. front end) was adapted to have a smooth gripping surface as well. Also, when the HB-II is in inactive state, the gate is in forward rotation, which also widens the gap more than the belt's width this eliminates belt friction and wear while the belt is moved forward or backward. Since the belt is blocked from moving backward in the active state, there is no belt wear in the backward motion as well. In addition, the HB-II's gripping wall is manufactured with a smooth gripping surface to minimize belt wear when it moves in the gap as well. In contrast, other belt fastening devices employ serrated surfaces with sharp teeth structures which engage the belt and are designed to block belt movement while in blocked state. However, sharp teeth surfaces cause significant belt wear even when they are in their unblocked state since their teeth remain pointed at the belt and the belt still touches them as it moves even in a wider gap. In our HB-II the sharp front end could be split into two or more separate blades which engage the belt simultaneously.

The HB-II has many advantages over previous devices primarily due to its efficient and easy fastening operation by a ratchet mechanism which requires the user just to pull the belt to the desired fastening level. Once the belt is pulled, it remains fastened until the ratcheting mechanism is switched from active state into inactive state whereby it disables the ratchet mechanism and releases the belt. Additional advantage over all the other belt ratchets is that its ratchet mechanism does not use belt imprinted toothed strips. Fastening belts with ratchet devices which have belt imprinted surfaces, which regularly have sharp teeth, as all other ratchet belt fasteners do, results in increased wear of the imprinted strips on the belts. As a consequence, the ratchet mechanisms of such devices malfunctions after short use. In contrast, the diagonal orientation of the tapered i.e. sharp edges at the sharp blade fronts of the turning gates in the HB-IIs, cause very little belt wear because each sharp blade front has a smooth side on which the belt can slide when it is fastened. The HB-II was worn and tested daily by the Applicant for more than a year on various belts without any noticeable belt wear.

DETAILED DESCRIPTION OF THE DRAWINGS

Figure 1:
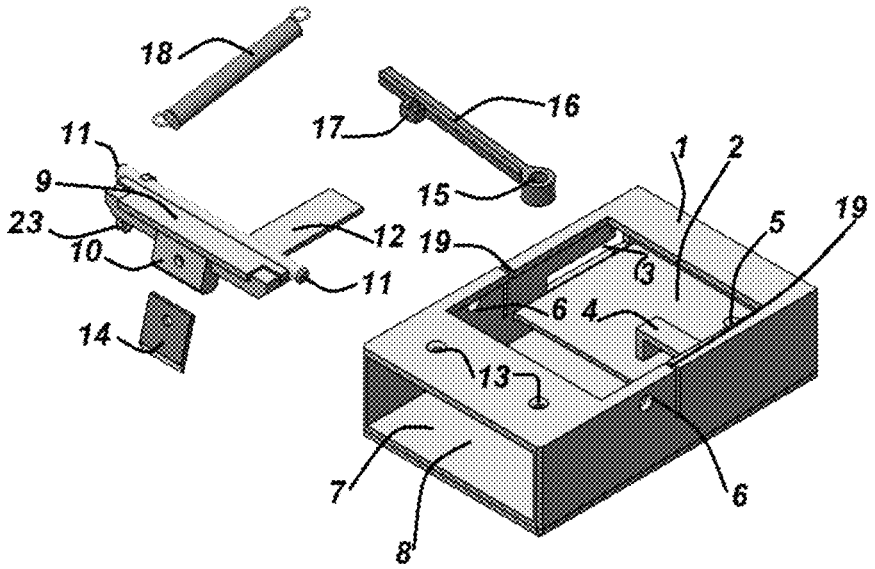
FIG. 1 illustrates in an isometric drawing a bottom view of the unassembled mechanical parts of HB-II.

FIG. 1 illustrates in an isometric drawing a bottom view of the unassembled mechanical parts of HB-II. The housing box 1 is shown in an upside-down position that allows better viewing of the structural details due to the large bottom opening of the box 1. The middle plate 2 which is parallel to the gripping wall 7 is installed at about the middle height of the housing box 1 and serves as the floor of the belt channel 8. A cavity 4 is attached to the middle plate 2 and is used to house the unattached end of the leaf spring 12. The lever's axle 5 is also attached to the middle plate 2. The lever's bearing 15 is installed on the axle 5. The lever 16 turns on the axle 5. The other end of the lever 16 protrudes through the L-shaped slit 3 at the side wall, which guides the lever between the lever's active state position and the lever's inactive state position. Two other apertures 6 drilled in the side walls of the housing box serve as bearings of the two axles 11 of the turning gate 9. An extension spring 18 is connected between the lever post 17 and the off-axial post 23 which is attached to the turning gate 9. The turning gate 9 also includes the blade holder 10 which houses the blade 14. The leaf spring 12 also is attached to the turning gate 9. Two slits 19 facilitate installation of the turning gate by temporarily bending the side walls. The holes 13 at the bottom wall of the box 1 are used to attach the second end of the belt to the housing box 1.

Figure 2:
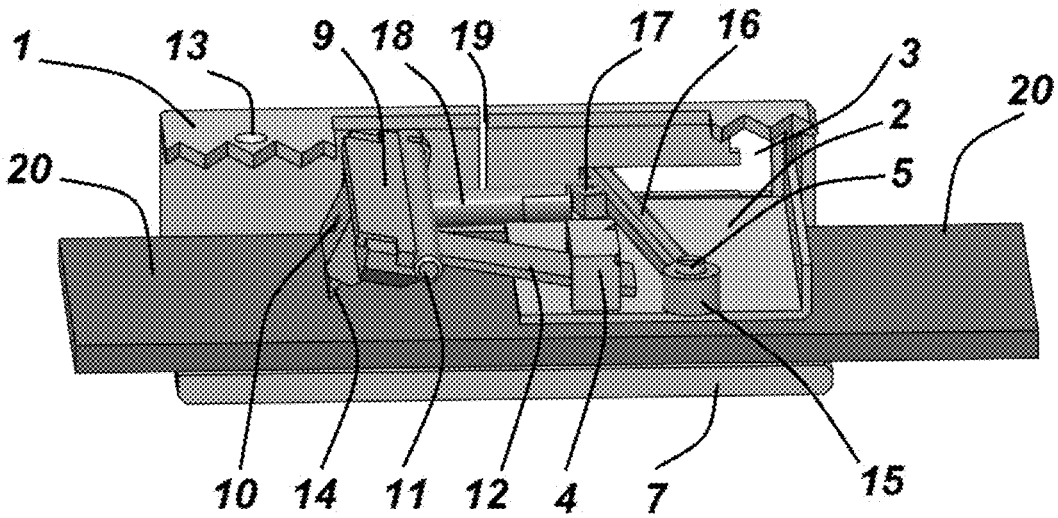
FIG. 2 depicts a cross-sectional bottom view of an assembled ratcheting device HB-II in an inactive state. The bottom belt and parts of the housing box were removed because they obstruct many structural details.

FIG. 2 depicts a cross-sectional bottom view of an assembled ratcheting device HB-II in an inactive state. The bottom belt 21 and parts of the housing box 1 were removed because they obstruct many structural details. The housing box 1 is shown in an upside-down position that allows better viewing of the structural details due to the large bottom opening of the housing box 1. The middle plate 2 which is parallel to the gripping wall 7 is installed at about the middle height of the housing box 1 and serves as the floor of the belt channel 8 which carries the upper belt 20. A cavity 4 is attached to the middle plate 2 and is used to house the unattached end of the leaf spring 12, which is shown in FIG. 2 in an unbent state because the turning gate 9 is forward turned and the blade 14 is not engaging the lower surface of the belt 20. The lever's axle 5 is also attached to the middle plate 2. The lever's bearing 15 is installed on the axle 5. The lever 16 turns on the axle 5. The other end of the lever 16 protrudes through the L-shaped slit 3 at the side wall, which guides the lever between the lever's active state position and the lever's inactive state position. The lever 16 in FIG. 2 is at the lever's inactive state position where the top end of the lever is at the left most position in the L-shaped slit 3. The turning gate 9, the blade holder 10 and the blade 14 are shown in FIG. 2 at their maximally forward turning position. An extension spring 18 is connected between the lever post 17 and the off-axial post 23 (obstructed in FIG. 2 by the turning gate 9) which is attached to the turning gate 9. The turning gate 9 also includes the blade holder 10 which houses the blade 14. The leaf spring 12 also is attached to the turning gate 9. One of the two slits 19 which facilitate installation of the turning gate by temporarily bending the side walls is shown in FIG. 2. One of the holes 13 at the bottom wall of the box 1 are used to attach the second end of the belt 21 (shown in FIGS. 4 and 5) to the housing box 1. In FIG. 2, the extension spring 18 is at the minimally extended position.

Figure 3:
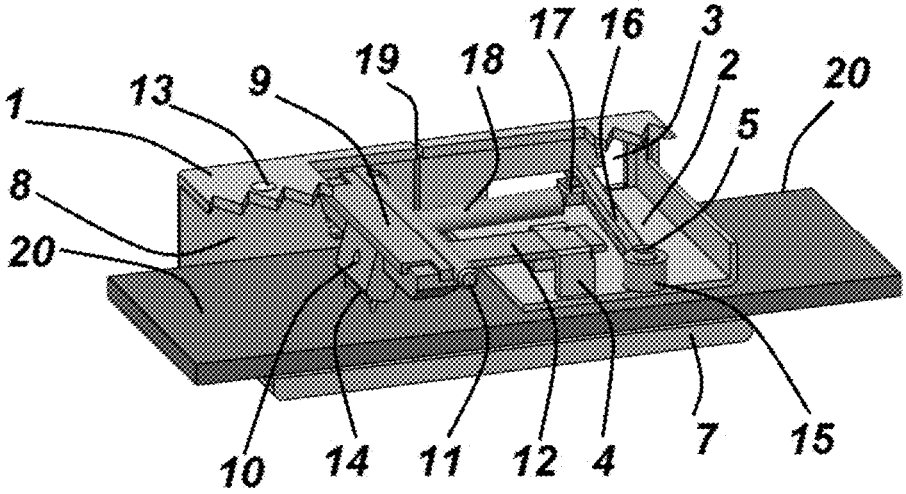
FIG. 3 describes a cross-sectional bottom view of an assembled ratcheting device HB-II in an active state. The bottom belt and parts of the housing box were removed because they obstruct many structural details.

FIG. 3 depicts a cross-sectional bottom view of an assembled ratcheting device HB-II in an active state. The bottom belt 21 and parts of the housing box 1 were removed because they obstruct many structural details. The housing box 1 is shown in an upside-down position that allows better viewing of the structural details due to the large bottom opening of the housing box 1. The middle plate 2 which is parallel to the gripping wall 7 is installed at about the middle height of the housing box 1 and serves as the floor of the belt channel 8 which carries the upper belt 20. A cavity 4 is attached to the middle plate 2 and is used to house the unattached end of the leaf spring 12, which is shown in FIG. 3 in a bent state because the turning gate 9 is backward turned and the blade 14 is engaging the lower surface of the belt 20. The lever's axle 5 is also attached to the middle plate 2. The lever's bearing 15 is installed on the axle 5. The lever 16 turns on the axle 5. The other end of the lever 16 protrudes through the L-shaped slit 3 at the side wall, which guides the lever between the lever's active state position and the lever's inactive state position. The lever 16 in FIG. 3 is at the lever's active state position where the top end of the lever is at the right most position in the L-shaped slit 3. The turning gate 9, the blade holder 10 and the blade 14 are shown in FIG. 3 at their maximally backward turning positions. An extension spring 18 is connected between the lever post 17 and the off-axial post 23 (obstructed in FIG. 3 by the turning gate 9) which is attached to the turning gate 9. The turning gate 9 also includes the blade holder 10 which houses the blade 14. The leaf spring 12 also is attached to the turning gate 9. One of the two slits 19 which facilitate installation of the turning gate by temporarily bending the side walls is shown in FIG. 3. One of the holes 13 at the bottom wall of the box 1, which are used to attach the second end of the belt 21 (shown in FIGS. 4 and 5) to the housing box 1. In FIG. 3, the extension spring 18 is at the maximally extended position.

Figure 4:
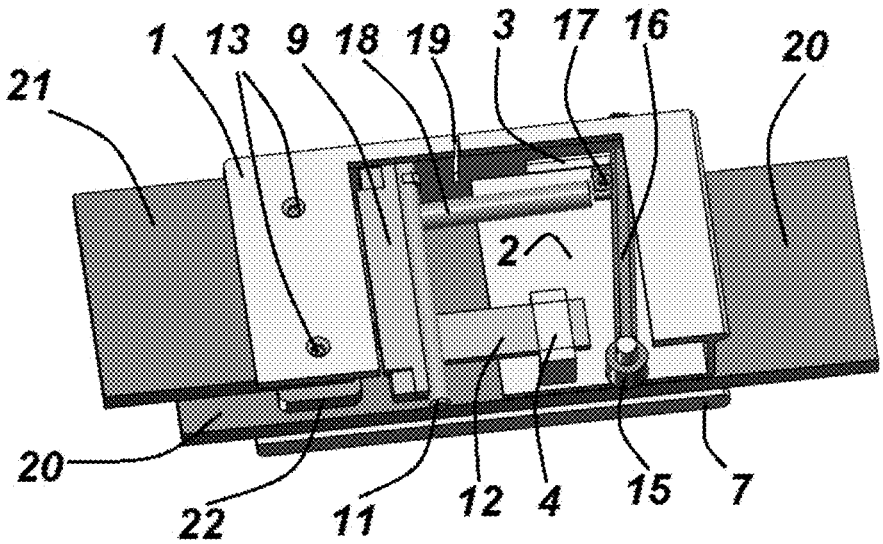
FIG. 4 illustrates a cross-sectional bottom view of an assembled ratcheting device HB-II in an active state. Some parts of the housing box were removed because they obstruct many structural details.

FIG. 4 depicts a cross-sectional bottom view of an assembled ratcheting device HB-II in an active state. Parts of the housing box 1 were removed because they obstruct many structural details. The housing box 1 is shown in an upside-down position that allows better viewing of the structural details due to the large bottom opening of the housing box 1. The middle plate 2 which is parallel to the gripping wall 7 is installed at about the middle height of the housing box 1 and serves as the floor of the belt channel 8 which carries the upper belt 20. A cavity 4 is attached to the middle plate 2 and is used to house the unattached end of the leaf spring 12, which is shown in FIG. 4 in a bent state because the turning gate 9 is backward turned and the blade 14 engaging the lower surface of the belt 20. The lever's axle 5 is also attached to the middle plate 2. The lever bearing 15 is installed on the axle 5. The lever 16 turns on the axle 5. The other end of the lever 16 protrudes through the L-shaped slit 3 at the side wall, which guides the lever between the lever's active state position and the lever's inactive state position. The lever 16 in FIG. 4 is at the lever's active state position where the top end of the lever is at the left most position in the L-shaped slit 3. The turning gate 9, the blade holder 10 and the blade 14 are shown in FIG. 4 at their maximally backward turning position. An extension spring 18 is connected between the lever post 17 and the off-axial post 23 (obstructed in FIG. 4 by the turning gate 9) which is attached to the turning gate 9. The turning gate 9 also includes the blade holder 10 which houses the blade 14. The leaf spring 12 also is attached to the turning gate 9. One of the two slits 19 which facilitate installation of the turning gate by temporarily bending the side walls is shown in FIG. 4. The holes 13 at the bottom wall of the box 1 are used to attach the second end of the belt 21 (shown in FIGS. 4 and 5) to the housing box 1. The plate 22 which is also used in connecting the second end of belt 21 to the housing box is also shown in FIG. 4. In FIG. 4, the extension spring 18 is at the maximally extended position.

Figure 5:
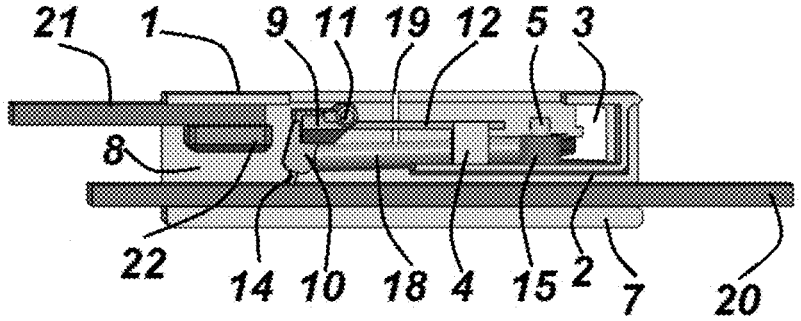
FIG. 5 depicts a cross-sectional side view of an assembled ratcheting device HB-II in an active state. Some parts of the housing box were removed because they obstruct many structural details.

FIG. 5 depicts a cross-sectional side view of an assembled ratcheting device HB-II in an active state. The bottom belt 21 and the plate 22 are also shown. The middle plate 2 which is parallel to the gripping wall 7 is installed at about the middle height of the housing box 1 and serves as the floor of the belt channel 8 which carries the upper belt 20. A cavity 4 is attached to the middle plate 2 and is used to house the unattached end of the leaf spring 12, which is shown in FIG. 5 in a bent state because the turning gate 9 is backward turned and the blade 14 is engaging the lower surface of the belt 20. The lever's axle 5 is also attached to the middle plate 2. The lever bearing 15 is installed on the axle 5. The lever 16 turns on the axle 5. The other end of the lever 16 protrudes through the L-shaped slit 3 at the side wall, which guides the lever between the lever's active state position and the lever's inactive state position. The lever 16 in FIG. 5 is at the lever's active state position where the top end of the lever is at the right most position in the L-shaped slit 3. The turning gate 9, the blade holder 10 and the blade 14 are shown in FIG. 5 at their maximally backward turning position. An extension spring 18 is connected between the lever post 17 and the off-axial post 23 (obstructed in FIG. 5 by the turning gate 9) which is attached to the turning gate 9. The turning gate 9 also includes the blade holder 10 which houses the blade 14. The leaf spring 12 also is attached to the turning gate 9. One of the two slits 19 which facilitate installation of the turning gate by temporarily bending the side walls is shown in FIG. 5. The holes 13 at the bottom wall of the box 1 are used to attach the second end of the belt 21 (shown in FIGS. 4 and 5) to the housing box 1. In FIG. 5, the extension spring 18 is at the maximally extended position.

Figure 6:
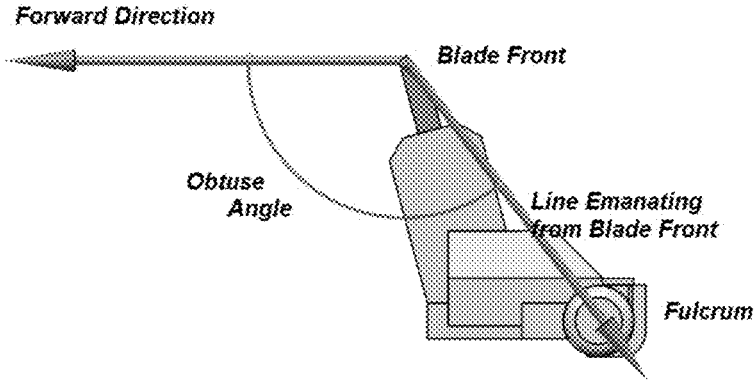
FIG. 6 describes the forward leaning diagonal arrangement of the turning gate and its attached blade front with respect to the fulcrum and the channel's forward direction.

(FIG. 6 describes the forward leaning diagonal arrangement of the turning gate and its attached blade front with respect to the fulcrum and the channel's forward direction. FIG. 6 shows that the turning gate is installed in the channel in a forward leaning diagonal orientation. As illustrated in FIG. 6, A straight line emanating from the blade front and passing through the axis of rotation (i.e. the fulcrum) is at an obtuse angle (i.e. an angle greater than 90 degrees but less than 180 degrees) with respect to the forward direction. It means that the obtuse angle which is centered at the blade front and is measured between the two lines emanating from the angle's center (the blade front). One line starts at the angle's center and passes through the axis of rotation (i.e. fulcrum) and the second line starts at the angle's center (i.e. the blade front) and is parallel to the forward direction of the channel.

What is claimed is:

1. A ratcheting device configured for fastening a belt and releasing a fastened belt;

wherein the ratcheting device comprising: a channel, a turning gate, a blade, a resilient part and the belt;

wherein the channel is being configured to carry through a portion of the belt;

the channel further comprises a gripping wall being adapted with a gripping surface configured to engage the belt;

the ratcheting device has an active state and an inactive state;

while in the active state, the ratcheting device is configured to restrict translation of the belt in the channel in a backward direction and to facilitate translation of the belt in the channel in a forward direction;

while in the inactive state, the ratcheting device is configured to facilitate translation of the belt both in the forward direction and in the backward direction;

the turning gate being rotationally engaged with the channel at a fulcrum, wherein the turning gate comprises a blade holder;

wherein the blade includes a blade front;

wherein the blade is installed into the blade holder such that the blade front protrudes in a front of the blade holder;

the turning gate is installed in the channel such that a straight line emanating from the blade front and passing through the fulcrum is at an obtuse angle with respect to the forward direction; wherein the blade front is disposed within the channel opposite the gripping wall such that there is a gap between the blade front and the gripping wall; wherein the belt is configured to pass through the gap between the blade front and the gripping wall;

the turning gate is configured to reduce the gap and to increase a pressure force exerted by the blade front on the belt when the turning gate is turned increasingly backward; wherein the turning gate is configured to increase the gap and to reduce the pressure force exerted by the blade front on the belt when the turning gate is turned increasingly forward;

at the active state, the blade front is configured to exert the pressure force on the belt and the blade front is configured to frictionally engage the belt and to turn forward the turning gate when the belt is translated in the forward direction;

in addition, at the active state the blade front is configured to frictionally engage the belt and to turn backward the turning gate when the belt is translated in the backward direction;

wherein at the active state the turning gate is configured to facilitate forward translation of the belt by turning increasingly forward and diminishing the pressure force of the blade front on the belt;

wherein at the active state the turning gate is configured to restrict backward translation of the belt by turning increasingly backward and increasing the pressure force of the blade front on the belt;

at the inactive state of the ratcheting device, the blade front is configured not to exert the pressure force on the belt and translation of the belt is facilitated both in the forward direction and in the backward direction;

wherein the resilient part is connected to the turning gate and also connected to a lever;

wherein the lever is configured to switch the ratcheting device into the active state when the lever has been moved into an active lever position;

wherein the lever is configured to switch the ratcheting device into the inactive state when the lever has been moved into an inactive lever position;

wherein the gripping surface of the gripping wall is facing downwards, and the blade front engages a lower surface of the belt by moving upwards.

2. The ratcheting device of claim 1, wherein the fulcrum comprises an axle which is fitted into a bearing.

3. The ratcheting device of claim 1, wherein the resilient part is structured as a spring which connects the lever to the turning gate at an off-axial post which is configured to turn the turning gate when pushed or pulled by the spring;

wherein moving the lever into the active lever position is configured to switch the ratcheting device into the active state by turning backward the turning gate;

wherein turning the turning gate backward, is configured to reduce the gap and to apply the pressure force on the belt; wherein at the active state the turning gate is configured to apply the pressure force on the belt;

wherein moving the lever into the inactive lever position is configured to switch the ratcheting device into the inactive state by turning forward the turning gate;

wherein turning forward the turning gate, is configured to increase the gap and to diminish the pressure force on the belt; wherein at the inactive state the turning gate is configured not to apply a pressure force on the belt.

4. The ratcheting device of claim 3, wherein a leaf spring is attached to the turning gate;

wherein an unattached end of the leaf spring is configured to fit into a cavity which is constructed into a channel's wall;

wherein the leaf spring is configured to be at an unbent state when the ratcheting device is in the inactive state;

wherein moving the lever into the active lever position is configured to switch the ratcheting device into the active state by turning backward the turning gate;

wherein, the leaf spring is configured to bend when the turning gate turns backward into the active state;

when the lever is moved into the inactive lever position it creates a forward spring force which is configured to switch the ratcheting device into the inactive state by turning forward the turning gate;

wherein the leaf spring is configured to supplement the forward spring force by providing an unbending force which helps to turn forward the turning gate.

5. The ratcheting device of claim 1, wherein the blade is tapered and sharpened at the blade front; wherein the sharp blade front is adapted with a smooth side;

wherein, the sharp blade front is configured to concentrate the pressure force on the belt when the turning gate is turned backward while the sharp blade front engages the belt;

wherein, the smooth side is configured to engage the belt when the turning gate is turned forward;

wherein, the smooth side is configured to facilitate the belt sliding while the turning gate is turned forward and the belt is translated.

6. The ratcheting device of claim 1, wherein the gripping surface of the gripping wall is adapted with a smooth gripping surface;

wherein, the smooth gripping surface is configured to facilitate the belt sliding when the belt is fastened at the active state and also when the belt is translated in the inactive state.

7. The ratcheting device of claim 1, wherein the ratcheting device further comprising a depression disposed on the gripping surface of the gripping wall; wherein the depression is configured to facilitate an additional bending of the belt due to the pressure force;

wherein, the additional bending is configured to increase a mutual friction force between the belt and the gripping surface of the gripping wall while the ratcheting device is in the active state and the belt is pulled in the backward direction.

8. The ratcheting device of claim 1, wherein the belt further comprises a first belt end and a second belt end; wherein the ratcheting device is configured for the belt fastening by tying the second belt end to the ratcheting device and fastening the first belt end with the ratcheting device; wherein, the second belt end is tied to the ratcheting device using screws or rivets; wherein, when the belt is fastened, the first belt end is configured to pull the ratcheting device in the backward direction, while second belt end is configured to pull the belt ratcheting device in the forward direction.

9. The ratcheting device of claim 1, wherein at least one ratcheting device which is anchored to a footwear item, is configured to fasten the belt which is attached to the footwear item.

10. The ratcheting device of claim 1, wherein the lever comprises of a lever pole, a lever bearing and a spring's tying post;

the lever bearing is attached to a bottom end of the lever pole; the spring's tying post is attached to a middle point of the lever pole and is connected to a first spring's end; a second spring's end is connected to an off-axial post attached to the turning gate; the ratcheting device is housed in a housing box; the top plane of the housing box is the gripping wall; wherein the gripping surface is facing downwards; the channel is located below the gripping wall between the gripping surface and an upper surface of a middle plate which is installed at a middle height of the housing box; wherein the upper surface of the middle plate serves as a channel's floor;

a lever axle is attached to a lower surface of the middle plate;

the lever bearing is installed on the lever axle; the lever pole is parallel to the middle plate and extends from the lever's bearing towards a side wall of the box; a top end of the pole protrudes from an I-shaped slit in the side wall, which is configured to guide the top end's motion.

11. The ratcheting device of claim 1, wherein the blade is made of metal.

12. The ratcheting device of claim 1, wherein the entire ratcheting device except the blade is made of plastics materials.

13. The ratcheting device of claim 1, wherein the resilient part consists of an extension spring; wherein a first end of the extension spring is connected to an off-axial post of the turning gate; wherein a second end of the extension spring is connected to a spring's tying post attached to the lever.

14. The ratcheting device of claim 10, wherein the turning gate comprises of a turning gate's axle with two turning gate's axle ends which are fitted into two turning gate's bearings, that are drilled at the side walls of the housing box.

* * * * *